United States Patent [19]

Rulison

[11] 3,975,482

[45] Aug. 17, 1976

[54] PROCESS FOR DRAWING ACRYLIC FIBROUS MATERIALS TO FORM A PRODUCT WHICH PARTICULARLY IS SUITED FOR THERMAL STABILIZATION AND CARBONIZATION

[75] Inventor: Richard N. Rulison, Medfield, Mass.

[73] Assignee: Celanese Corporation, New York, N.Y.

[22] Filed: June 10, 1974

[21] Appl. No.: 477,971

Related U.S. Application Data

[63] Continuation-in-part of Ser. No. 265,033, June 21, 1972, abandoned.

[52] U.S. Cl. ..... 264/131; 264/29.1; 264/136; 264/182; 264/DIG. 19; 423/447.1; 427/112; 427/174; 427/227

[51] Int. Cl.[2] ..... B29C 25/00; B28B 11/06

[58] Field of Search ..... 264/131, 130, 182; 423/447; 427/174, 112, 227

[56] References Cited

UNITED STATES PATENTS

| | | | |
|---|---|---|---|
| 2,034,008 | 3/1936 | Taylor | 264/131 |
| 2,432,776 | 12/1947 | Lis et al. | 264/130 |
| 2,697,023 | 12/1954 | Martin | 264/182 |
| 3,508,874 | 4/1970 | Rulison | 423/447 |
| 3,520,766 | 7/1970 | Newman | 264/290 R |
| 3,656,903 | 4/1972 | Stuetz | 423/447 |

*Primary Examiner*—Jay H. Woo

[57] ABSTRACT

An improved process for drawing a continuous length of an acrylic multifilament fibrous material is provided. Prior to drawing at an elevated temperature by continuous passage through a suitable drawing zone the surface of the fibrous material is coated with powdered graphite (e.g. colloidal graphite) via contact with a dipersion containing the graphite paticles which serve to improve the drawing properties of the same. The process is suited for the hot drawing of a continuous length of an acrylic multifilament fibrous material (e.g. a substantially untwisted tow) which is intended for subsequent thermal stabilization, and cabonization to form a carbonaceous fibrous material.

12 Claims, 1 Drawing Figure

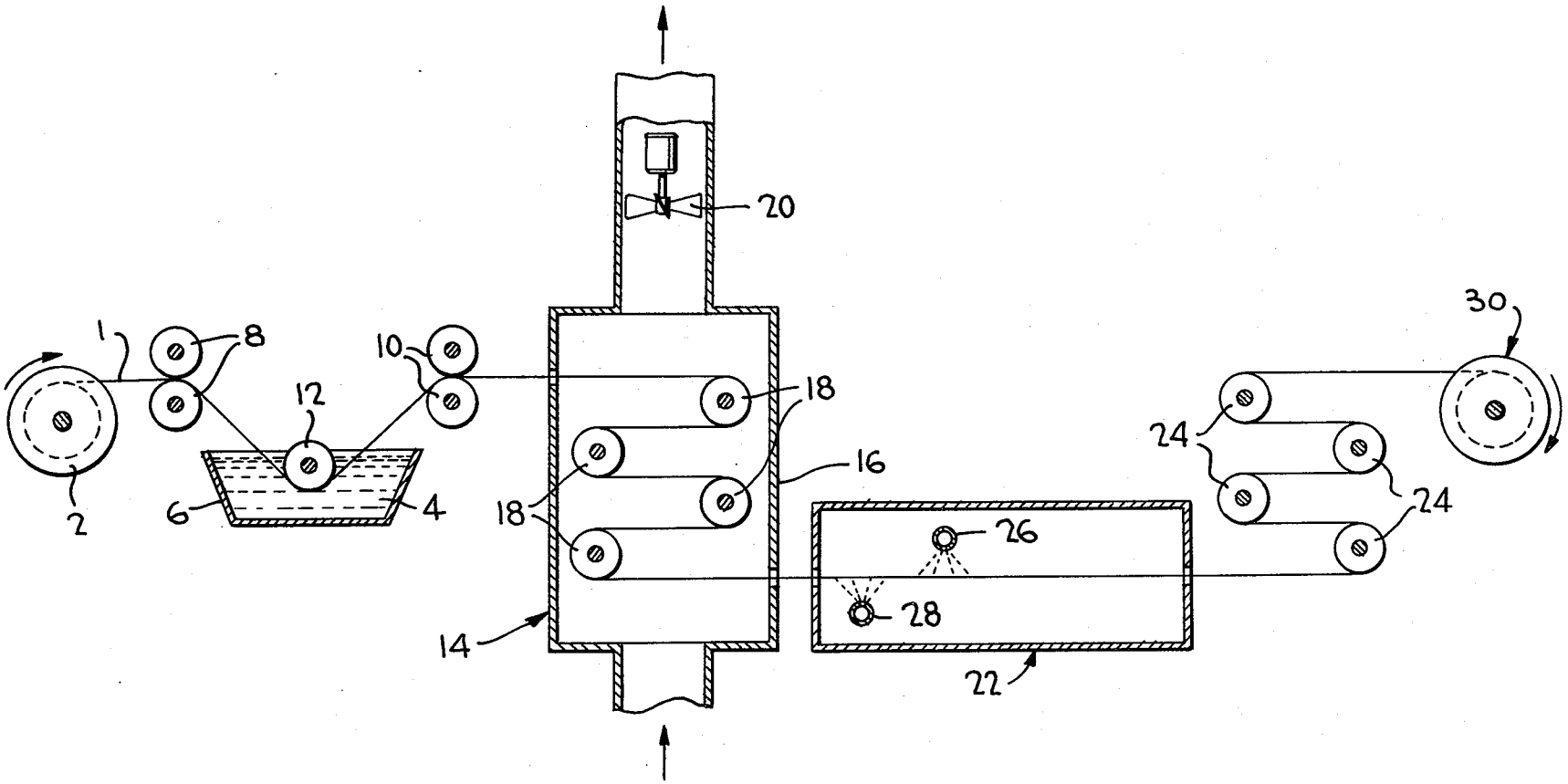
30
24
24
22
26
28
16
18
20
18
14
10
4
12
8
6
1
2

PROCESS FOR DRAWING ACRYLIC FIBROUS MATERIALS TO FORM A PRODUCT WHICH PARTICULARLY IS SUITED FOR THERMAL STABILIZATION AND CARBONIZATION

CROSS-REFERENCE TO RELATED APPLICATION

This is a continuation-in-part of U.S. Serial No. 265,033, filed June 21, 1972 (now abandoned).

BACKGROUND OF THE INVENTION

It has long been known that the hot drawing of an acrylic fibrous material is capable of beneficially enhancing the tensile properties thereof through molecular orientation. Drawing or stretching acrylic fibrous materials accordingly commonly is practiced prior to most fiber end use applications.

During the initial formation of an acrylic multifilament fibrous material complete filament size uniformity is difficult to achieve. Upon subsequent drawing broken filaments within the multifilament fibrous material are commonly observed at least some of which may be traced to filament size diversity. Such broken filments have an adverse influence upon process stability during the hot drawing operation. For instance, a broken filament during passage through the drawing zone may become wound upon a roll to form a roll wrap which requires a shut down of the drawing operation to eliminate the same. The uniform quality of the product is accordingly reduced. Productivity is diminished and labor costs are increased.

Heretofore, those interested in improving the stability of hot drawing operations have concentrated primarily upon various mechanical refinements of the drawing equipment involved. Rollers present in the drawing zone may be provided with a matte finish rather than a highly polished finish. Devices have been employed in association with the rollers to remove filaments which tend to adhere to the same, e.g. doctor blades, brushes, compressed air jets, etc. Additionally, various dressings for the fibrous material have been proposed wherein a continuous coating is applied to the same.

When an acrylic fibrous material is intended for use as a precursor in the formation of a carbonaceous fibrous material via thermal processing, it is particularly advantageous that the fibrous material uniformly possess a high degree of molecular orientation which may be difficult to reliably impart to the same employing standard drawing technology particularly when the fibrous material is substantially untwisted and consists of thousands of individual filaments.

In my commonly assigned U.S. Pat. No. 3,508,874 entitled "Production of Carbon Yarns" is disclosed an improved process for the thermal stabilization and carbonization of an acrylic fibrous material. The fibrous material which undergoes processing in the process described therein is preferably highly molecularly oriented. See, also, commonly assigned U.S. Pat. No. 3,539,295 of Michael J. Ram for an additional representative process for the thermal conversion of an acrylic fibrous material to a carbonaceous fibrous material.

It is an object of the invention to provide an improved process for the drawing of a continuous length of an acrylic multifilament fibrous material.

It is an object of the invention to provide an improved process for the drawing of a continuous length of an acrylic multifilament fibrous material which is carried out on a continuous basis in an efficient manner under highly stable operating conditions.

It is an object of the invention to provide an improved process for the drawing of a continuous length of an acrylic multifilament fibrous material wherein the individual filaments thereof are uniformly drawn and the frequency of filament breakage commonly observed during the drawing of a multifilament fibrous material is substantially reduced.

It is an object of the invention to provide an improved process for the drawing of a continuous length of an acrylic fibrous material which produces a drawn fibrous product of improved quality.

It is a further object of the invention to provide an improved process for the drawing of an acrylic multifilament fibrous material which yields a drawn product which particularly is suited for subsequent thermal stabilization and carbonization to form a carbonaceous fibrous material.

These and other objects as well as the scope, nature, and utilization of the improved process will be apparent from the following detailed description and appended claims.

SUMMARY OF THE INVENTION

It has been found that in a continuous process for the drawing of an acrylic multifilament fibrous material selected from the group consisting of an acrylonitrile homopolymer and an acrylonitrile copolymer containing at least about 85 mol percent of acrylonitrile units and up to about 15 mol percent of one or more monovinyl units copolymerized therewith wherein a continuous length of the multifilament fibrous material is continuously passed for a brief residence time through a drawing zone provided at a temperature of about 100° to 175°C. while under the influence of a longitudinal tension wherein the continuous length of multifilament fibrous material is elongated while undergoing no substantial thermal stabilization; improved results are achieved by:

a. passing the continuous length of acrylic fibrous material prior to the drawing through a liquid medium containing a dispersion of powdered graphite so as to coat the surface of the individual filaments of the fibrous material with the liquid medium, and b. passing the resulting continuous length of acrylic multifilament fibrous material bearing the coating of the liquid medium thereon through a drying zone wherein the liquid portion of the medium is substantially expelled and the surface of the filaments is provided with a coating of the powdered graphite wherein an uptake of powdered graphite of about 0.5 to 20 percent by weight based upon the weight of the fibrous material is accomplished with the powdered graphite serving to improve the drawing properties of the acrylic multifilament fibrous material and aiding in the formation of an elongated multifilament fibrous material which is particularly suited for thermal stabilization and carbonization to form a multifilament carbonaceous fibrous material.

BRIEF DESCRIPTION OF THE DRAWING

The drawing is a schematic presentation of an apparatus arrangement capable of carrying out the improved drawing process of the present invention.

DESCRIPTION OF PREFERRED EMBODIMENTS

The acrylic multifilament fibrous material which serves as the starting material in the present process is provided as a continuous length which is preferably substantially untwisted. The exact configuration of the fibrous assemblage may be varied as will be apparent to those skilled in the art. In a particularly preferred embodiment of the process the continuous length of fibrous material is in the form of a tow which may be flattened to enhance its handling characteristics. The number of substantially parallel continuous filaments present within the continuous length may range from about 50 up to 500,000, or more, and the exact number of filaments is not critical to the operation of the process.

The continuous length of multifilament acrylic fibrous material which is drawn in accordance with the present process may optionally have undergone previous drawing by a conventional technique wherein it was drawn to less than maximum degree achievable. Alternatively, the fibrous material may be provided in an as-spun condition (e.g. wet spun or dry spun) which has undergone no substantial drawing subsequent to its formation. Melt spinning commonly is not utilized to form an as-spun acrylic fibrous material. The acrylic fibrous material prior to drawing in the present process has undergone no form of thermal stabilization such as that described in my U.S. Pat. No. 3,508,874.

The acrylic fibrous material may be either an acrylonitrile homopolymer or an acrylonitrile copolymer containing at least about 85 mol percent of acrylonitrile units and up to about 15 mol percent of one or more monovinyl units copolymerized therewith. Representative monovinyl compounds which are copolymerizable with acrylonitrile include styrene, methyl acrylate, methyl methacrylate, vinyl acetate, vinyl chloride, vinylidene chloride, vinyl pyridine, and the like.

The graphite powder which is applied as a coating upon the surface of the acrylic multifilament fibrous material prior to hot drawing is provided in a finely divided form which is capable of loosely adhering to the individual filaments of the continuous length of fibrous material as discrete particles. The powdered graphite commonly is termed colloidal graphite and has been found to perform substantially better in the present process than amorphous forms of carbon such as carbon black. The exact particle size of the graphitic carbon is not considered to be critical; however, it is preferred that the number average particle size be less than 10 microns, and most preferably less than 5 microns (e.g. 0.01 to 1 micron). The particle size may be determined via examination in an electron microscope employing standard analysis techniques wherein the longest dimension of each particle examined is measured. Conventional BET analysis techniques may also be utilized.

The coating of finely divided graphite is preferably applied by (a) passing a continuous length of the multifilament acrylic fibrous material prior to drawing through a liquid medium containing a dispersion of the finely divided material so as to coat the surface of the individual filaments of the fibrous material with the liquid medium, and (b) passing the resulting continuous length of multifilament acrylic fibrous material bearing the coating of liquid medium through a drying zone wherein the liquid portion of the medium is substantially expelled and the surface of the filaments of the acrylic fibrous material is provided with a coating of powdered graphite which is capable of improving the drawing properties of the multifilament fibrous material. The application of the powdered graphite from a dispersion enables the particles readily to move into the interior of the assemblage of acrylic filaments. Such a uniform introduction of the powdered graphite is not possible when the particles are floated upon the surface of a liquid and the fibrous material merely passed therethrough.

The nature of the dispersing medium is not critical. The only requirements being that the dispersing medium be incapable of substantially dissolving the finely divided solid, and incapable of adversely influencing the acrylic multifilament fibrous material. For example, the dispersing medium may be aqueous in nature. Lower alcohols, mineral spirits, and low moleculr weight liquid hydrocarbons can be readily employed. The preferred dispersing medium is isopropanol because of its ease of volatilization, good wetting characteristics, and relatively low toxicity. The powdered graphite may be provided in the liquid medium in a concentration of about 2 to 8 percent by weight based upon the total weight of the dispersion (e.g. about 4 percent by weight). Other factors influencing the content of the powdered graphite in the liquid medium include the specific nature of the acrylic multifilament fibrous material, and the processing speed.

A minor quantity of a surface-active agent optionally may be provided in the liquid medium to assist the dispersion of the powdered graphite as will be apparent to those skilled in fine particle technology. A representative anionic surfactant is sodium dodecylbenzene sulfonate. A minor quantity of a resin optionally may be provided in the liquid medium and may function both as a protective colloid for the dispersion and as a binder for the particulate coating which is depostited upon the filaments, e.g. an alkyd resin as used in paints. Other optional binders include sodium silicate, etc.

The drying zone in which the liquid medium (i.e. the dispersing medium) is substantially expelled may be either a heated gaseous atmosphere in which the continuous length of the acrylic multifilament fibrous material is axially suspended or a heated contact surface which engages the moving fibrous material (e.g. one or more heated roll). The temperature of the drying zone is maintained below that at which the properties of the polymeric fibrous material are adversely influenced, and is also influenced by the relative volatility of the dispersing medium selected. The total residence time in the drying zone is influenced by the temperature of the drying zone, the fiber denier, and relative density of the individual filaments within the continuous length of multifilament acrylic fibrous material as will be apparent to those skilled in the art. Representative temperatures for the drying zone commonly range from about 50° to 105°C., and representative drying zone residence times commonly range from about 5 seconds to about 1 minute.

Upon drying it is preferred that the uptake of the finely divided graphitic carbon upon the surface of the acrylic multifilament fibrous material be about 0.1 to 20 percent by weight (e.g. 0.5 to 20 percent by weight) based upon the weight of the fibrous material, and most preferably about 2 to 8 percent by weight.

The acrylic multifilament fibrous material bearing the coating of powdered graphite next is drawn while continuously passed for a brief residence time through a drawing zone provided at an elevated temperature while under the influence of a longitudinal tension wherein it is elongated while undergoing no substantial thermal stabilization and no fiber coalescence. The exact drawing conditions will vary somewhat with the specific polymeric material involved, and may be selected from those hot drawing techniques already known in the art. The only difference being that the acrylic multifilament fibrous material bears a coating of powdered graphite upon its surface. The drawing may be conducted as the continuous length of coated fibrous material is suspended within a drawing zone containing a heated gaseous atmosphere or as the continuous length of coated fibrous material is passed over a hot contact surface, e.g. one or more hot shoe or pin. The drawing serves to increase the molecular orientation within each filament of the multifilament fibrous material and to decrease the denier of the fibrous material.

The draw ratio selected will be influenced by whether the continuous length of acrylic multifilament fibrous material has undergone prior drawing. The desired drawing may be conducted in a single stage or in a plurality of stages.

It is preferred that the drawing zone in which the acrylic fibrous material is suspended during drawing be heated by the introduction of steam (e.g. saturated or superheated steam). Suitable drawing temperatures (e.g. in steam) for the acrylic fibrous material may commonly range from about 100° to 175°C. At such draw temperatures the individual filaments of the fibrous material can be expected to exhibit no tendency to coalesce during drawing even in the absence of the powdered graphite. An as-spun acrylic fibrous material may be drawn at a draw ratio of about 1.2:1 up to about 8:1, or up to just below the point at which the continuous length breaks. The continuous length of acrylic fibrous material may be fed to the drawing zone at a rate of up to about 100 meters per minute. The residence time in the drawing zone will commonly vary from about 1 to 15 seconds.

The theory whereby the coating of powdered graphite upon the surface of the acrylic multifilament fibrous material serves to improve the drawing process is considered complex and incapable of simple explanation. It is observed, however, that the presence of the powdered graphite serves to greatly improve the stability of the drawing operation. Roll wraps commonly encountered in the prior art whereby a broken filament adheres to a roller surface and becomes wound thereon are greatly reduced, and rarely occur when practicing the process of the present invention. The fibrous material shows a lesser tendency to adhere to roll surfaces with which it comes in contact while under longitudinal tension. Labor requirements are accordingly reduced. Also, the presence of the powdered graphite has been found to greatly diminish the tendency for the filaments to accumulate static electricity. The uniform drawing of each filament is aided through the presence of the powdered graphite which may be attributable to the facile and independent filament movement made possible by natural lubricity of the graphite particles. Product quality is improved.

The resulting drawn acrylic fibrous material particularly is suited for subsequent stabilization and carbonization to form a carbonaceous fibrous material. If desired, the powdered graphite optionally may be removed from the drawn multifilament acrylic fibrous material by scouring.

The following Example is given as a specific illustration of the improved process of the present invention with reference being made to the drawing. It should be understood, however, that the invention is not limited to the specific details set forth in the Example.

EXAMPLE

A flat tow 1 of an acrylonitrile copolymer consisting of about 90.8 mol percent acrylonitrile units, about 9.2 mol percent methyl acrylate units, and a very minor proportion of copolymerized dye site improving units is selected as the starting material. The tow 1 which is continuously unwound from package 2 is substantially untwisted and consists of approximately 160,000 continuous filaments substantially coextensive with its length. The filaments of the tow have been previously drawn employing a standard drawing technique and possess an average denier per filament of about 3, and a single filament tenacity of about 2.8 grams per denier.

The tow 1 is continuously passed through an aqueous colloidal dispersion of graphite 4 present in vessel 6. The colloidal graphite has a number average particle size of about 0.8 micron and is present in the aqueous dispersion medium in a concentration of about 4 percent by weight based upon the total weight of the dispersion.

Pairs of nip rolls 8 and 10 engage the tow immediately prior to its introduction into the aqueous colloidal dispersion of graphite and immediately after its withdrawal from the same. Roll 12 serves to engage the tape while it is immersed in the aqueous colloidal dispersion of graphite 4. As the tape is removed from vessel 6, the surface of the individual filaments is coated with the aqueous dispersion of colloidal graphite.

The tape bearing a coating of the colloidal graphite and water is next passed through a drying zone 14 wherein the water portion of the coating is substantially expelled and the surface of the filaments is provided with a coating of colloidal graphite. The uptake of colloidal graphite is about 2 percent by weight based upon the weight of the tow. The drying zone is bounded by casing 16 and is provided with a series of tensioning rolls 18. The tensioning rolls 18 are internally heated by electrical resistance heaters and provided with a surface temperature of about 120°C. As the water is evolved it is withdrawn from drying zone 14 by the aid of fan 20. The tape is present in drying zone 14 for a residence time of about 10 seconds.

The dried tape bearing a coating of colloidal graphite is next passed to drawing zone 22 at a rate of 10 meters per minute wherein it is drawn at a draw ratio of 2:1 while under the influence of a longitudinal tension exerted by tensioning rolls 24. Saturated steam at atmospheric pressure is introduced into drawing zone 22 via jets 26 and 28 with the temperature of the gaseous atmosphere within the drawing zone being maintained at 100°C. The tape is present in the drawing zone for a residence time of about 4 seconds. The resulting drawn tape is taken up on package 30 at a rate of 20 meters per minute.

For comparative purposes an identical tape is drawn as heretofore described with the exception that no colloidal graphite coating is present upon the same. Broken filaments are observed which have a tendency to wrap upon tensioning rolls 24.

Although the invention has been described with a preferred embodiment, it is to be understood that variations and modifications may be resorted to as will be apparent to those skilled in the art. Such variations and modifications are to be considered within the scope of the claims appended hereto.

I claim:

1. In a continuous process for the drawing of an acrylic multifilament fibrous material selected from the group consisting of an acrylonitrile homopolymer and an acrylonitrile copolymer containing at least about 85 mol percent of acrylonitrile units and up to about 15 mol percent of one or more monovinyl units copolymerized therewith wherein a continuous length of said multifilament fibrous material is continuously passed for a brief residence time through a drawing zone provided at a temperature of about 100° to 175°C. while under the influence of a longitudinal tension wherein said continuous length of multifilament fibrous material is elongated while undergoing no substantial thermal stabilization; the improvement comprising:

a. passing said continuous length of acrylic fibrous material prior to said drawing through a liquid medium containing a dispersion of powdered graphite so as to coat the surface of the individual filaments of said fibrous material with said liquid medium, and b. passing said resulting continuous length of acrylic multifilament fibrous material bearing said coating of said liquid medium thereon through a drying zone wherein the liquid portion of said medium is substantially expelled and the surface of the filaments is provided with a coating of said powdered graphite wherein an uptake of powdered graphite of about 0.5 20 percent by weight based upon the weight of the fibrous material is accomplished with said powdered graphite serving to improve the drawing properties of said acrylic multifilament fibrous material and aiding in the formation of an elongated multifilament fibrous material which is particularly suited for thermal stabilization and carbonization to form a multifilament carbonaceous fibrous material.

2. An improved process for the drawing of an acrylic multifilament fibrous material according to claim 1 wherein the continuous length of fibrous material is in the form of a substantially untwisted tow.

3. An improved process for the drawing of an acrylic multifilament fibrous material according to claim 1 wherein the liquid portion of said liquid medium is an aqueous medium.

4. An improved process for the drawing of an acrylic multifilament fibrous material according to claim 1 wherein the liquid portion of said liquid medium is isopropanol.

5. An improved process for the drawing of an acrylic multifilament fibrous material according to claim 1 wherein an uptake of powdered graphite of about 2 to 8 percent by weight based upon the weight of the fibrous material is accomplished.

6. An improved process for the drawing of an acrylic multifilament fibrous material according to claim 1 wherein said fibrous material is an acrylonitrile homopolymer.

7. An improved process for the drawing of an acrylic multifilament fibrous material according to claim 4 wherein said continuous length of fibrous material consists of about 50 to 500,000 substantially parallel untwisted filaments.

8. An improved process for the drawing of an acrylic multifilament fibrous material according to claim 1 wherein said powdered graphite has a number average particle size of less than 10 microns.

9. An improved process for the drawing of an acrylic multifilament fibrous material according to claim 1 wherein said powdered graphite has a number average particle size of less than 5 microns.

10. An improved process for the drawing of an acrylic multifilament fibrous material according to claim 1 wherein said powdered graphite has a number average particle size of about 0.01 to 1 micron.

11. An improved process for the drawing of an acrylic multifilament fibrous material according to claim 1 wherein said drying zone is provided at about 50° to 105°C.

12. An improved process for the drawing of an acrylic multifilament fibrous material according to claim 1 wherein steam is provided to said drawing zone.

* * * * *